US007379689B2

(12) United States Patent
Kotani

(10) Patent No.: US 7,379,689 B2
(45) Date of Patent: May 27, 2008

(54) SHEET POST-PROCESSING APPARATUS

(75) Inventor: Takashi Kotani, Osaka (JP)

(73) Assignee: Kyocera Mita Corporation (JP)

( * ) Notice: Subject to any disclaimer, the term of this patent is extended or adjusted under 35 U.S.C. 154(b) by 375 days.

(21) Appl. No.: 11/274,466

(22) Filed: Nov. 15, 2005

(65) Prior Publication Data

US 2006/0103065 A1 May 18, 2006

(30) Foreign Application Priority Data

Nov. 16, 2004 (JP) ..... 2004-331412

(51) Int. Cl.
*G03G 15/00* (2006.01)

(52) U.S. Cl. ..... 399/160; 399/407

(58) Field of Classification Search ..... 399/107, 399/160, 405, 407, 408, 410; 270/52.14, 270/52.18, 58.08, 58.09
See application file for complete search history.

(56) References Cited

U.S. PATENT DOCUMENTS 6,457,705 B2 * 10/2002 Nanba et al. ..... 270/58.12
6,729,376 B1 * 5/2004 Kakinuma et al. ..... 156/521
7,248,829 B2 * 7/2007 Kobayashi ..... 399/410

FOREIGN PATENT DOCUMENTS

JP 2001-89009 * 4/2001
JP 2004-246056 9/2004

* cited by examiner

*Primary Examiner*—Hoan Tran
(74) *Attorney, Agent, or Firm*—Gerald E. Hespos; Anthony J. Casella

(57) ABSTRACT

A sheet post-processing apparatus has a stacking section for storing sheets received from an image forming apparatus for post-processing, a sheet saving section for temporarily saving a specified number of sheets being conveyed to the stacking section and then causing them to accompany a sheet conveyed next for the batch feed of the sheets, and a controller for executing a control to batch feed remaining sheets by causing the remaining sheets to accompany the temporarily saved sheets of a previous set if the remaining sheets falls short of the number of the sheets to be batch fed. Even if the total number of the sheets saved in the auxiliary storing section and the last sheet of the sheet bundle falls short of the preset batch feed number, the need for temporarily suspending the conveyance of the first sheet of the next bundle can be eliminated to speed-up the sheet processing.

4 Claims, 11 Drawing Sheets

SAVED SHEET NUMBER = 1 (BATCH FEED NUMBER = 2),
NUMBER OF SHEETS IN SHEET BUNDLE = ODD NUMBER)

SAVED SHEET NUMBER = 2 (BATCH FEED NUMBER = 3),
NUMBER OF SHEETS IN SHEET BUNDLE = A MULTIPLE OF 3 PLUS 1

SHEET POST-PROCESSING APPARATUS

BACKGROUND OF THE INVENTION

1. Field of the Invention

The present invention relates to a sheet post-processing apparatus for applying a specified post-processing to sheets fed from an image forming apparatus such as a copier, a facsimile machine or a printer.

2. Description of the Related Art

There has been known a sheet post-processing apparatus for applying a specified post-processing to sheets conveyed from an image forming apparatus. This sheet post-processing apparatus successively receives and aligns sheets fed from the image forming apparatus installed at an upstream side in a main storing section, and discharges the sheets after applying a post-processing such as stapling with a unit set of sheets (one bundle) stored.

Normally, in the sheet post-processing apparatus, the sheets of one bundle can be received one by one in accordance with sheet feeding intervals from the image forming apparatus. However, since longer time is taken to staple a specified number of sheets forming one unit set with these sheets stored in the storing section, it is not possible to deal with the sheets successively fed from the image forming apparatus. It has been a general practice to temporarily suspend the operation of the image forming apparatus in order to solve this problem. However, this leads to the temporary suspension of an image formation processing, which causes a problem of reducing the processing efficiency of the image formation processing including the post-processing.

A sheet post-processing apparatus disclosed in Japanese Unexamined Patent Publication No. 2004-246056 temporarily stores the first one of a plurality of sheets of one bundle fed from an image forming apparatus on the circumferential surface of a temporarily storing drum as an auxiliary storing section separately provided, and staples the bundle of sheets stored in a storing section during the temporary storage of the first sheet. The sheet temporarily save on the temporarily storing drum is fed to the storing section emptied upon completing the stabling to the previous bundle of sheets while accompanying the next sheet conveyed from the image forming apparatus. By employing such a measure, it is not necessary to temporarily suspend the image formation processing and, accordingly, the processing efficiency of the image forming apparatus can be improved.

Japanese Unexamined Patent Publication No. 2004-246056 also discloses another mode in which temporary storage on the temporarily storing drum is applied not only to the first sheet of the bundle of sheets, but also to all the sheets and, for example, the sheets are alternately temporarily saved on the temporarily storing drum to feed the one sheet temporarily stored and the next sheet together to the storing section. By feeding the two sheets to the storing section together, a time required to align the sheets in the storing section is partly compensated for by the temporarily storage of the sheets, wherefore more sheets can be processed per unit time to speed up the image formation processing.

In the sheet processing apparatus disclosed in the above publication, if the sheets are alternately saved on the temporarily storing drum by applying the temporary storage not only to the first sheet of one bundle, but also to all the sheets, the last sheet cannot be temporarily saved on the temporarily storing drum after the sheets are fed in pairs to the storing section in the case where the number of the sheets in one bundle is an odd number (i.e., the last sheet is fed to the storing section while accompanying the first sheet of the next bundle if being temporarily stored), with the result that a time required for the post processing in the main storing section cannot be ensured.

In order to solve such a problem, in the apparatus disclosed in the above publication, the first sheet of the next bundle being conveyed is temporarily suspended and the last sheet of the previous bundle is fed to the storing section during the temporary suspension of the conveyance to apply a specified post-processing to this bundle of sheets.

However, if the conveyance of the first sheet of the next bundle is temporarily stopped, it leads to the necessity to also temporarily suspend the image formation processing. This causes a problem of reducing the processing efficiency of the entire image formation processing.

SUMMARY OF THE INVENTION

It is an object of the present invention to provide a sheet post-processing apparatus which is free from the problems residing in the prior art.

It is another object of the present invention to provide a sheet post-processing apparatus which can reduce the sheet processing time.

According to an aspect of the invention, a sheet post-processing apparatus for applying a specified post-processing to a sheet bundle formed. The apparatus is provided with a main storing section for storing sheets successively received from an upstream apparatus while stacking the sheets one over another for application of a post-processing, an auxiliary storing section disposed immediately upstream of the main storing section to form a set including a batch feed number of sheets to be batch fed. The auxiliary storing section temporarily saves a specified number of sheet(s) being fed to the main storing section and cause the temporarily saved sheet(s) to accompany the sheet conveyed next, thereby batch feeding the set of the sheets to the main storing section. The apparatus is further provided with a controller for executing such a control as to batch feed remaining sheet(s) by causing the remaining sheets to accompany the temporarily saved sheet(s) of a previous set if the remaining sheet(s) falls short of the batch feed number.

These and other objects, features, aspects, and advantages of the present invention will become more apparent from the following detailed description of the preferred embodiments/examples with reference to the accompanying drawings.

BRIEF DESCRIPTION OF THE DRAWINGS

FIGS. 3A and 3B are diagrams showing a sheet saving operation of the sheet saving section shown in FIG. 2, wherein FIG. 3A shows a state where a sheet is being introduced to the sheet saving section and FIG. 3B shows a state where the sheet stored in the sheet saving section is being discharged.

DETAILED DESCRIPTION OF THE PREFERRED EMBODIMENTS

Figure 1:
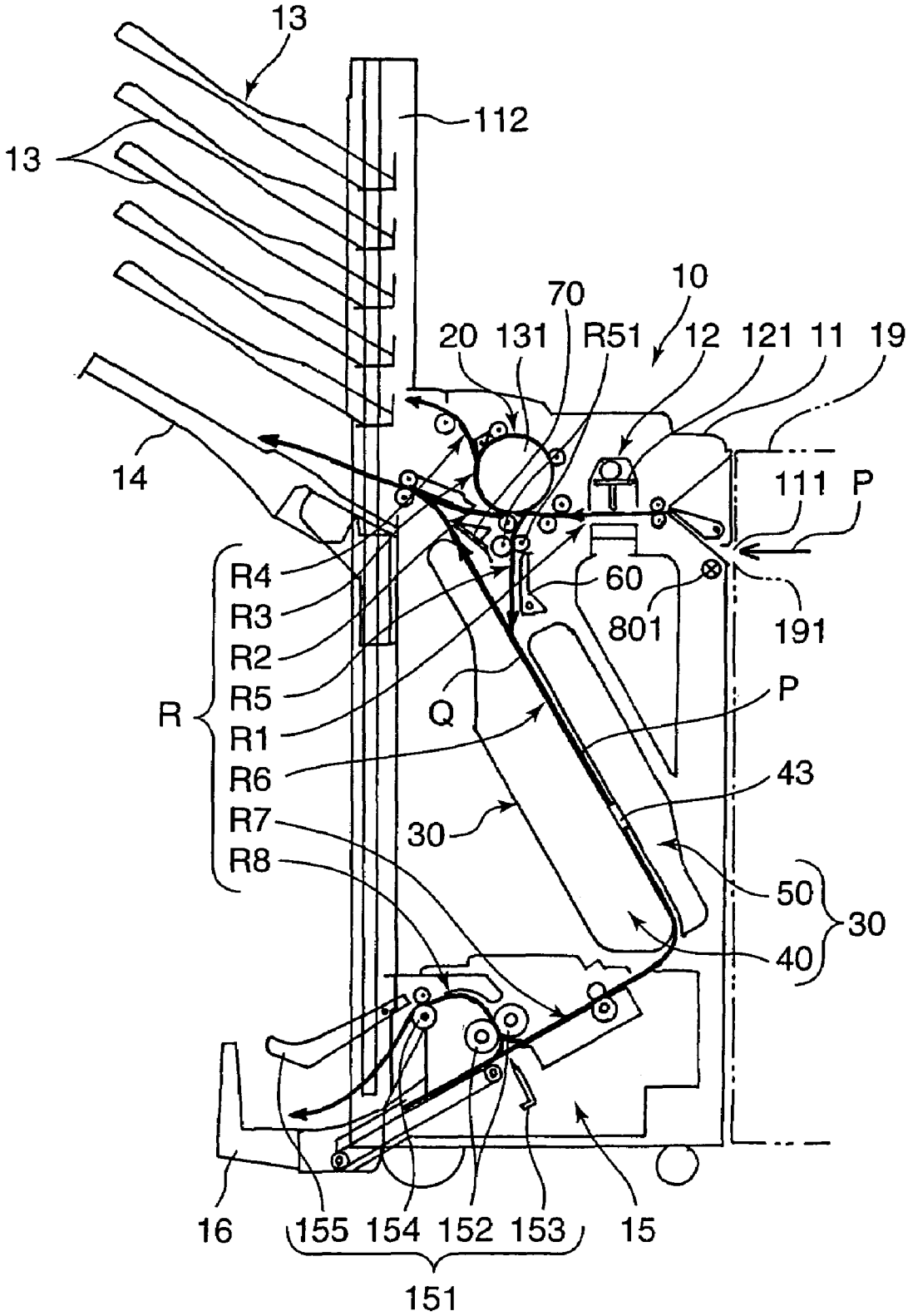
FIG. 1 is a diagram showing an inner construction of a sheet post-processing apparatus according to an embodiment of the invention.

Referring to FIG. 1 showing an inner construction of a sheet post-processing apparatus embodying the invention, a sheet post-processing apparatus 10 is installed adjacent to an image forming apparatus (upstream apparatus) 19 for which copiers, facsimile machines or various printers can be used. In a vertically long box-shaped casing 11 are provided a punch unit 12 for making perforations in a sheet P along a sheet conveyance path R, a sheet saving section 20 (auxiliary storing section) disposed downstream (left in FIG. 1) of the punch unit 12 for sorting the sheets P according to the destination, a stacking section (main storing section) 30 disposed below the sheet saving section 20 for temporarily storing the bundle (sheet bundle Q) of the discharged sheets P, stapling the sheet bundle Q, and a folding section 15 for folding the sheet bundle Q in the middle after the stapling.

On the other hand, a job tray assembly 13 disposed on the rear side, a general-purpose tray 14 disposed below the job tray assembly 13 and a folding tray 16 disposed at the bottom end of the casing 11 in such a manner as to face the general-purpose tray 14 are provided outside the casing 11. The sheets P or the sheet bundle Q to which no folding is applied are discharged onto the job tray assembly 13 and the general-purpose tray 14, whereas the sheet bundle Q to which folding was applied in the folding section 15 is discharged onto the folding tray 16.

The sheet conveyance path R is comprised of an entrance-side conveyance path R1, a general-tray oriented conveyance path R2, a looped conveyance path R3, a job-tray oriented conveyance path R4, a stacking-section oriented conveyance path R5, a stacking-section inner conveyance path R6, a folding-section inner conveyance path R7 and a folding/discharging conveyance path R8. The conveyance path R1 extends from a sheet receiving opening 111 defined to face the image forming apparatus 19 at a right-upper part of the casing 11 in FIG. 1 to the sheet saving section 20. The conveyance path R2 extends straight from the conveyance path R1 to the general-purpose tray 14. The conveyance path R3 is branched off upward from the conveyance path R2 and formed in the sheet saving section 20. The conveyance path R4 is branched off at an intermediate position of the conveyance path R3 to extend upward to the job tray assembly 13. The conveyance path R5 extends down from the sheet saving section 20 toward the stacking section 30. The conveyance path R6 is so formed in the stacking section 30 as to vertically extend. The conveyance path R7 is so formed in the folding section 15 as to communicate with the conveyance path R6 and obliquely extend. The conveyance path R8 is for carrying out the sheet bundle Q to which folding was applied in the folding section 15.

The punch unit 12 is disposed at a position above the entrance-side conveyance path R1. Inside such a punch unit 12 is provided a punching mechanism 121 for moving a punching blade upward and downward, wherein the sheet P introduced to the entrance-side conveyance path R1 is perforated at a specified position by moving the punching blade downward and upward by driving the punching mechanism 121 with the conveyance temporarily stopped.

Figure 2:
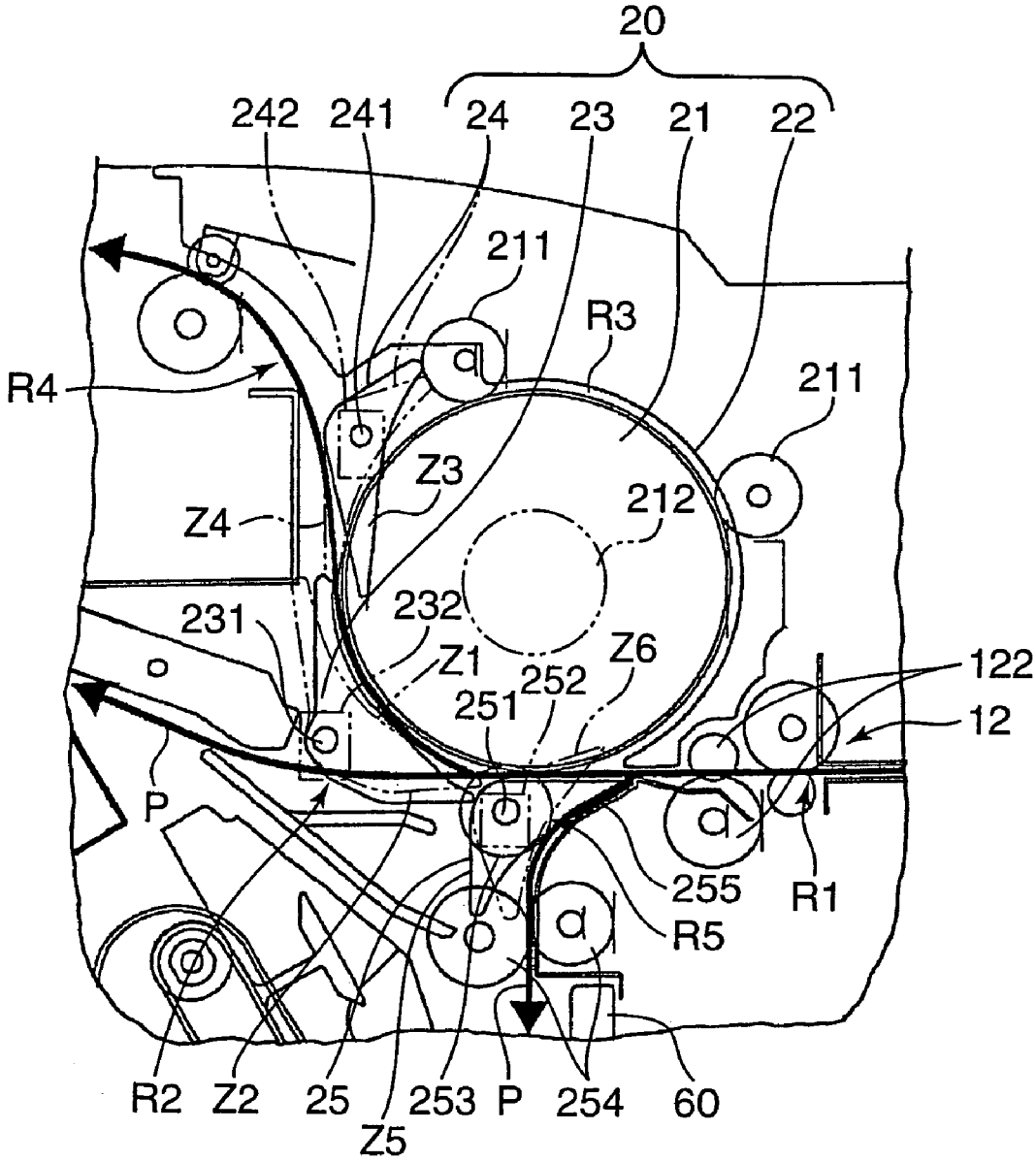
FIG. 2 is a side view of a sheet saving section of the apparatus.
Figure 3A:
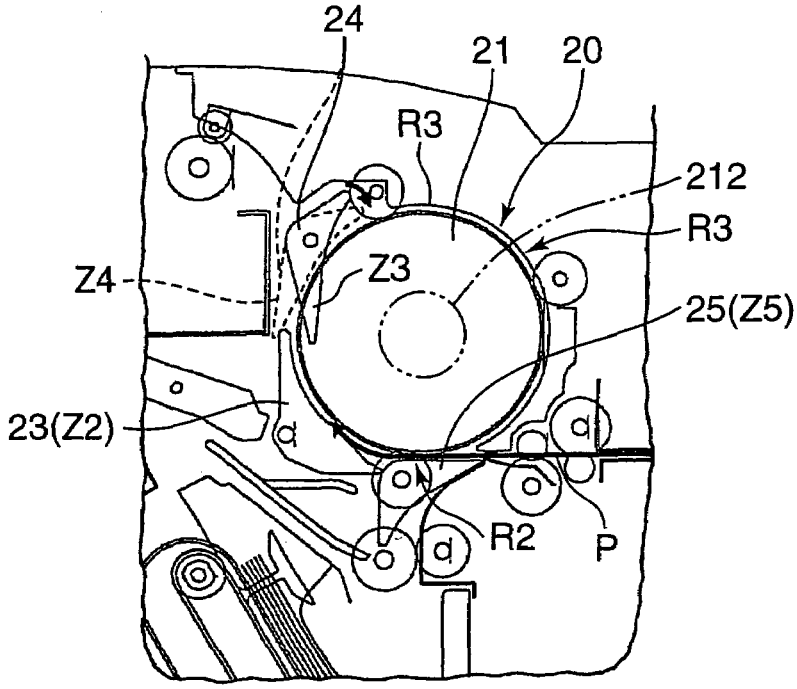
Figure 3B:
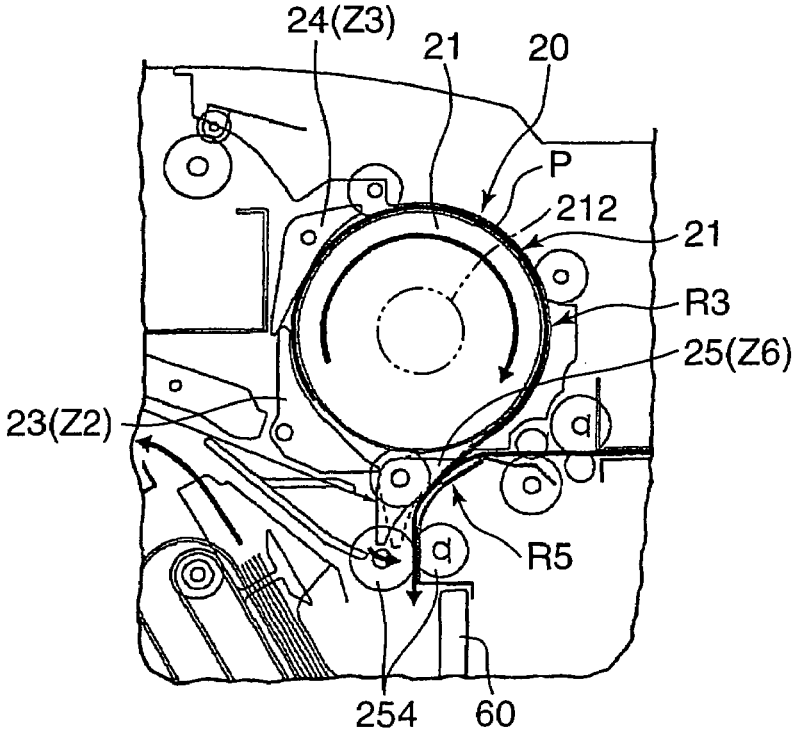

FIG. 2 is a side view of one embodiment of the sheet saving section 20, and FIGS. 3A and 3B are diagrams showing a sheet saving operation of the sheet saving section 20 shown in FIG. 2, wherein FIG. 3A shows a state where the sheet P is being introduced to the sheet saving section 20 and FIG. 3B shows a state where the sheet P stored in the sheet saving section 20 is being discharged.

First, as shown in FIG. 2, the sheet saving section 20 is disposed at a position above an immediate downstream side of the general-tray oriented conveyance path R2 at the downstream end (left in FIG. 2) of the entrance-side conveyance path R1, and includes a cylindrical temporarily storing drum (annular member) 21 whose center axis extends in the width direction of the sheet which is orthogonal to a sheet conveying direction, an arcuate covering member 22 covering a substantially right half of the temporarily storing drum 21 in FIG. 2 while defining a specified clearance thereto, a first switching guide 23 covering a lower-left part of the temporarily storing drum 21 in FIG. 2, and a second switching guide 24 covering an upper-left part of the temporarily storing drum 21 in FIG. 2. The annular conveyance path R3 is formed by an annular clearance formed between the inner surfaces of the arcuate covering member 22, the first and second switching guides 23, 24 and the outer circumferential surface of the temporarily storing drum 21.

A specified number of temporarily storing rollers 211 are arranged at positions facing specified positions of the outer circumferential surface of the temporarily storing drum 21, wherein the sheet P introduced to the annular conveyance path R3 advances while being tightly held between the outer circumferential surfaces of these temporarily storing rollers 211 and the outer circumferential surface of the temporarily storing drum 21.

The temporarily storing drum 21 can be driven about the center axis thereof by a drum motor 212. The sheet P introduced into the annular conveyance path R3 is discharged toward the first conveyance path R6 via the stacking-section oriented conveyance path R5 by the clockwise rotation of the temporarily storing drum 21 by the drum motor 212. A plurality of sheets P can be stored on such a temporarily storing drum 21.

The first switching guide 23 is so supported at a position slightly above the general-purpose tray oriented conveyance path R2 as to be rotatable about a first shaft 231 extending in the sheet width direction orthogonal to the sheet conveying direction, and is displaceable to a general-purpose tray oriented posture Z1 (shown in phantom line in FIG. 2) where the sheet P is guided toward the general-purpose tray oriented conveyance path R2 and an annular conveyance path oriented posture Z2 (shown in solid line in FIG. 2) where the sheet P is guided to the annular conveyance path R3.

The second general-purpose 24 is so supported at a position slightly above a point of the annular conveyance path R3 branched off to the job-tray oriented conveyance path R4 as to be rotatable about a second shaft 241 extending in the sheet width direction orthogonal to the sheet conveying direction, and is displaceable between a job-tray oriented posture Z3 (shown in solid line in FIG. 2) where the sheet P is guided toward the job-tray oriented conveyance path R4 and an annular conveyance path oriented posture Z4 (shown in phantom line in FIG. 2) where the sheet is successively guided to the annular conveyance path R3.

The first switching guide 23 has the posture thereof changed between the general-purpose tray oriented posture Z1 and the annular conveyance path oriented posture Z2 by the forward and reverse driving of a first actuator 232 using a solenoid or the like, and the second switching guide 24 also has the posture thereof changed between the job-tray oriented posture Z3 and the annular conveyance path oriented posture Z4 by the forward and reverse driving of a second actuator 242 using a solenoid or the like.

At a position immediately below the temporarily storing drum 21 is disposed an entrance switching guide 25 for switching the destination of the sheet P conveyed from the entrance-side conveyance path R1 via a pair of first conveyance rollers 122 to the general-purpose tray oriented conveyance path R2 and the stacking-section oriented conveyance path R5. The entrance switching guide 25 is in the form of a right triangle whose oblique side is arcuate, and is displaceable between a general-purpose tray oriented posture Z5 (shown in solid line in FIG. 2) where the sheet P is guided to the general-purpose tray conveyance path R2 and a stacking-section oriented posture Z6 (shown in phantom line in FIG. 2) where the sheet P is guided to the stacking-section conveyance path R5 by the forward and reverse driving about an entrance-side shaft 251 parallel with the first shaft 231 by an entrance-side actuator 252.

A guide roller 253 is supported on the entrance-side shaft 251, and a pair of second conveyance rollers 254 are disposed at positions immediately below the guide roller 253. On the other hand, an arcuate guiding plate 255 having a shape convex toward the upper-left side in FIG. 2 and held in contact with the circumferential surface of the guide roller 253 is provided between a nip between the second conveyance rollers 254 and a nip between the first conveyance rollers 122. The sheet P having passing the pair of first conveyance rollers 122 moves down along the stacking-section oriented conveyance path R5 while being tightly held by the arcuate guiding plate 255 and the entrance switching guide 25 with the entrance switching guide 25 set in the stacking-section oriented posture Z6, and is introduced to the stacking-section inner conveyance path R6 via the second conveyance rollers 254.

Accordingly, the entrance switching guide 25 is set in the stacking-section oriented posture Z6 when the sheet P conveyed from the punch unit 12 is conveyed toward the stacking-section inner conveyance path R6. Thus, the sheet P from the punch unit 12 is guided to the entrance switching guide 25 set in the stacking-section oriented posture Z6, and is introduced to the stacking-section inner conveyance path R6 via the stacking-section oriented conveyance path R5 and the pair of second conveyance rollers 254.

On the contrary, if the first switching guide 23 is set in the general-purpose tray oriented posture Z1 with the entrance switching guide 25 set in the general-purpose tray oriented posture Z5, the sheet P conveyed toward the sheet saving section 20 from the punch unit 12 is discharged onto the general-purpose tray 14 via the general-purpose tray oriented conveyance path R2. On the other hand, the sheet P is guided toward the annular conveyance path R3 as shown in FIG. 3A by setting the first switching guide 23 in the annular conveyance path oriented posture Z2.

The sheet P conveyed toward the annular conveyance path R3 by setting the first switching guide 23 in the annular conveyance path oriented posture Z2 is guided by the second switching guide 24 to move toward the job tray assembly 13 with the second switching guide 24 set in the job-tray oriented posture Z3. On the other hand, the sheet P is guided to the back side of the annular conveyance path R3 by the second switching guide 24 by setting the second switching guide 24 in the annular conveyance path oriented posture Z4, and is temporarily stored on the temporarily storing drum 21 while being wound around it.

On the other hand, upon discharging the sheet P temporarily stored in the annular conveyance path R3 toward the stacking-section conveyance path R6, the entrance switching guide 25 has the posture thereof set to enable the conveyance of the sheet P toward the stacking-section inner conveyance path R6. The sheet P stored in the annular conveyance path R3 is discharged from the annular conveyance path R3 on the temporarily storing drum 21 as shown in FIG. 3B by driving the drum motor 212 in this state, moves along the stacking-section oriented conveyance path R5 while being guided by the entrance switching guide 25, and moves toward the stacking-section inner conveyance path R6 via the second conveyance rollers 254.

Referring back to FIG. 1, the job tray assembly 13 is comprised of a plurality of unit trays 131 arranged one above another at specified intervals, and can select any one of the unit trays 131 depending on the kind of the job. For this selection, the job tray assembly 13 is made movable upward and downward along a supporting column 112 standing at the left side of the casing 11 in FIG. 1. Upon the selection of a desired unit tray 131, the base end of this unit tray 131 is set at a position facing the downstream end of the job-tray oriented conveyance path R4. Accordingly, the sheet P discharged via the job-tray oriented conveyance path R4 is discharged onto the unit tray 131 selected beforehand.

The general-purpose tray 14 is for receiving, particularly, the sheets P and the sheet bundle Q for which no unit tray 131 was selected as the discharging end at the job tray assembly 13, i.e., ordinary sheets P discharge via the general-purpose tray oriented conveyance path R2 and the sheet bundle Q to which a specified post-processing was applied in the stacking-section inner conveyance path R6. Upon discharging the sheet P or the sheet bundle Q onto the general-purpose tray 14, the height of the general-purpose tray 14 is set such that the base end thereof faces the downstream end of the general-purpose tray oriented conveyance path R2.

The stacking section 30 (see FIG. 1) is for temporarily storing the sheets P successively introduced to the stacking-section inner conveyance path R6 via the stacking-section oriented conveyance path R5 to form a sheet bundle Q and for aligning the end of the thus formed sheet bundle Q and binding, i.e., stapling the sheet bundle Q. The downstream end of the stacking-section oriented conveyance path R5 faces a position slightly above an intermediate position of the stacking-section inner conveyance path R6, whereas the upstream end of the stacking-section inner conveyance path R6 faces the general-purpose tray oriented conveyance path R2.

Accordingly, the sheets P introduced to the stacking-section inner conveyance path R6 through the stacking-section oriented conveyance path R5 are aligned in a specified manner in the stacking section 30 to become the sheet bundle Q, to which stapling is applied. The stapled sheet bundle Q is discharged from the upper end of the stacking-section inner conveyance path R6 onto the general-purpose tray 14 via the general-purpose tray oriented conveyance path R2. The stacking section 30 is described in detail later with reference to FIG. 4.

The folding section 15 folds the sheet bundle Q stapled in a middle part at this middle part, and includes a folding unit 151.

This folding unit 151 is provided with a pair of folding rollers 152 disposed above a middle part of the folding-section inner conveyance path R7, a force plate 153 disposed below the folding-section inner conveyance path R7 to face the roller pair 152 and to cross the folding-section inner conveyance path R7, a pair of carry-out rollers 154 provided at a downstream end of the folding/discharging conveyance path R8, and a pressing member 155 disposed at the downstream side of the carry-out rollers 154 in such a manner as to be pivotal about a specified axis.

The force plate 133 presses the stapled part of the sheet bundle Q toward a nip between the folding rollers 152 by being driven by an unillustrated driving means with the sheet bundle Q taken into the folding-section inner conveyance path R7. Accordingly, the sheet bundle Q folded in the middle by having the middle part thereof pushed by the force plate 153 is pushed into the folding/discharging conveyance path R8 and is discharged on the folding tray 16 via the folding/discharging conveyance path R8, the pair of carry-out rollers 154 and the pressing member 155.

Figure 4:
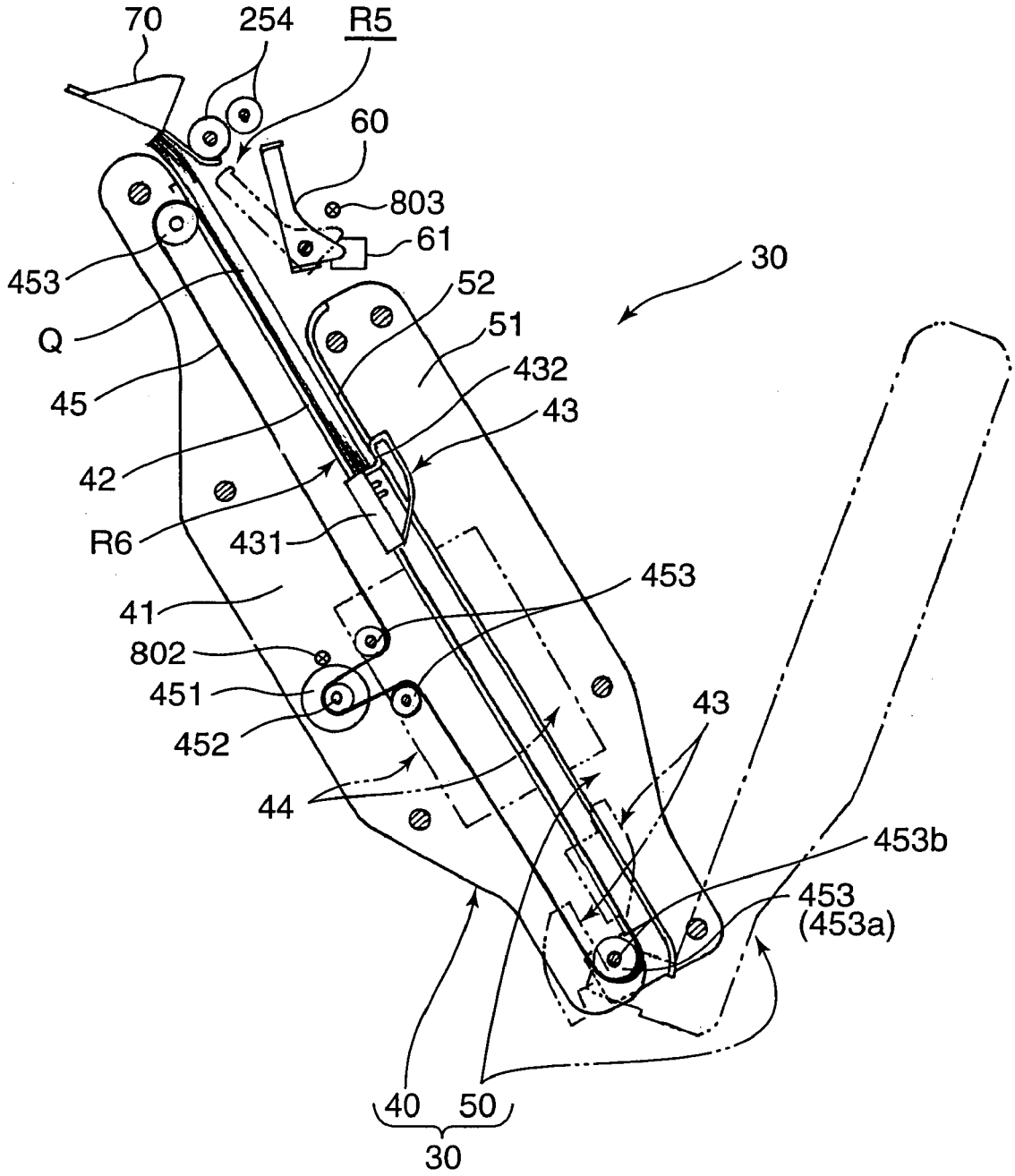
FIG. 4 is a side view showing a stacking section of the apparatus.

The stacking section 30 is described below with reference to FIG. 4 and, if necessary, also to FIG. 1. FIG. 4 is a schematic side view showing one embodiment of the stacking section 30. As shown in FIG. 4, the stacking section 30 is provided with a receiving unit 40 for receiving the sheet P from the stacking-section oriented conveyance path R5 and a cover unit 50 openably and closably mountable on a sheet receiving surface of the receiving unit 40.

The receiving unit 40 is constructed such that sheet receiving plates 42 for receiving the sheets P, a sheet elevating member 43, a stapling mechanism 44, and an endless belt 45 are disposed between a pair of side plates 41. The side plates 41 have such a length that the upper ends thereof face the general-purpose tray oriented conveyance path R2 and the bottom ends thereof are located at a lower-right part of the casing 11, are obliquely oriented and are spaced apart along width direction (direction orthogonal to the plane of FIG. 4). The sheet elevating member 43 moves the sheet bundle Q stacked up on the sheet receiving plates 42 between an upper position and a lower position along the sheet receiving plates 42. The stapling mechanism 44 is installed at a substantially vertical middle position between the respective side plates 41. The endless belt 45 moves the sheet elevating mechanism 43 upward and downward along the sheet receiving plates 42.

A plurality of sheet receiving plates 42 are juxtaposed along width direction, and the endless belt 45 is so arranged as to be located in a clearance between the juxtaposed sheet receiving plates 42. The sheet elevating member 43 is fixed to the endless belt 45 provided between the sheet receiving plates 42, and is moved upward and downward along the sheet receiving plates 42 by turning the endless belt 45 in forward and reverse directions.

The sheet elevating member 43 is comprised of a fixing portion 431 having a U-shaped cross section and fixed to the endless belt 45 while crossing over the endless belt 45, and a sheet bundle receiving portion 432 integrally coupled to the fixing portion 431 for receiving the sheet bundle Q. The sheet bundle receiving portion 432 is L-shaped in side view, and receives the sheets P introduced to the stacking-section inner conveyance path R6 using its angled part.

The stapling mechanism 44 staples the sheet bundle Q supported on the sheet elevating member 43 between the receiving unit 40 and the cover unit 50, and includes a staple feeding mechanism, a driving mechanism for driving the fed staple into the sheet bundle Q, etc.

As shown in FIG. 4, the endless belt 45 is mounted on a specified number of belt supporting rollers extending between the pair of side plates 41 and is turned by being driven by a belt motor 451 disposed at a substantially longitudinal middle position between the side plates 41. The belt supporting rollers include a drive roller 452 fixed concentrically with the drive shaft of the belt motor 451, and a plurality of driven rollers 453 at an upper end position and a bottom end position between the side plates 42 and at such positions between the side plates 41 as to mount the endless belt 45 on the drive roller 452.

Accordingly, the endless belt 45 is turned in forward and reverse directions between the respective driven rollers 453 via the drive roller 452 by driving the belt motor 451 in forward and reverse directions, whereby the sheet elevating member 43 coupled to the endless belt 45 can be moved upward and downward along the sheet receiving plates 42.

Further, as shown in FIG. 4, the sheet elevating member 43 is movable from a sheet bundle supporting position between the receiving unit 40 and the cover unit 50 to a retracted position, which is a substantially bottom most position between the side plates 40, by way of the bottom-most one 453*a* of the driven rollers 453. By the displacement of the sheet elevating member 43 to the retracted position, the stacking-section inner conveyance path R6 comes to communicate with the folding-section inner conveyance path R7, whereby the sheet bundle Q stapled in the stapling mechanism 44 can move toward the folding-section inner conveyance path R7 to be folded.

The cover unit 50 is mounted on the receiving unit 40 in order to guide the upward and downward movements of the sheet bundle Q formed by discharging the sheets P into the stacking-section inner conveyance path R6 by being opposed to the sheet receiving plates 42 of the receiving unit 40. The cover unit 50 includes a pair of side plates 51 spaced apart along width direction (direction orthogonal to the plane of FIG. 4), and a covering plate 52 opposed to the sheet receiving plates 42 of the receiving unit 40 between the pair of side plates 51.

Such a cover unit 50 is rotatably supported about a roller shaft 453*b* bearing the bottommost roller 453*a*, and is displaceable between a closing posture shown in solid line in FIG. 4 for closing the stacking-section inner conveyance path R6 and an opening posture shown in phantom line in FIG. 4 for opening the stacking-section inner conveyance path R6 by being driven in forward and reverse directions about the roller shaft 453*b*.

In the embodiment, as shown in FIG. 4, a biasing member 60 is provided at a position obliquely above the upper end of the cover unit 50 and behind (to right in FIG. 4) the stacking-section oriented conveyance path R5 substantially immediately below the pair of second conveyance rollers 254, and a posture holding member 70 is provided at a position above the biasing member 60 and before the front one of the second conveyance rollers 254.

The biasing member 60 is for biasing the rear edge (upper edge) of the sheet P discharged to the stacking-section inner conveyance path R6 via the second conveyance rollers 254 toward the sheet receiving plates 42 of the receiving unit 40. By moving the sheet elevating member 43 upward with the sheet P biased, the upper end of the sheet bundle Q is guided into between the posture holding member 70 and the sheet receiving plates 42, thereby preventing the sheet(s) P having reached the stacking-section inner conveyance path R6 from interfering with the sheet P conveyed next.

In the embodiment, in order to equalize an imbalance in timing between the specified post-processing (stapling in this embodiment) applied to one sheet bunch Q and the feed of the sheets at specified conveying intervals from the image forming apparatus 19 to the sheet post-processing apparatus 10 (i.e., in order to synchronize the post-processing and the feed), a specified number (number of sheets to be batch fed) of sheets P fed from the image forming apparatus 19 at specified time intervals are temporarily stored in the sheet saving section 20, and is introduced to the stacking section 30 while being caused to accompany the sheet P conveyed from the image forming apparatus 19 next.

The above arrangement is made for the following reason. Specifically, the image processing ability of the image forming apparatus 19 has come to be speeded up in recent years, thereby shortening the time intervals of the successive conveyances of the sheets P from the image forming apparatus 19 to the sheet post-processing apparatus 10. On the other hand, a specified time is required to align the sheet bundle Q in the stacking section 30, which is done every time the sheet P is carried into the stacking section 30. This aligning operation has become unable to come up with the sheet conveying intervals.

For example, each odd one of the sheets P successively conveyed from the image forming apparatus 19 to the sheet post-processing apparatus 10 is carried into and temporarily stored in the sheet saving section 20, and the temporarily stored sheet P is caused to accompany a corresponding even one of the sheets successively conveyed with one sheet stored in the sheet saving section 20 to introduce two sheets to the stacking section 30 together. Then, the operation of aligning the sheet bundle Q by moving the sheet elevating member 43 upward and downward in the stacking section 30 can be performed within a period which is twice as long as the sheet conveying interval. As a result, the speeding-up of the image formation processing in the image forming apparatus 19 can be realized.

The number of the sheet(s) P temporarily stored in the sheet saving section 20 is not limited to one, and two, three or more can also be suitably set in consideration of the image processing speed in the image forming apparatus 19 and the aligning speed of the sheet bundle Q in the stacking section 30.

In the case of adopting a plural-sheet simultaneous batch feeding method for simultaneously conveying a plurality of sheets P to the stacking section 30, assuming that T denotes a sum total (batch feed number) of the number "m" of the sheet(s) P to be temporarily stored in the sheet saving section 20 and one sheet P conveyed from the image forming apparatus 19 next to accompany the stored sheet(s), i.e., the number of a series of sheets to be batch fed, sheet(s) P (remainder sheet(s)) less than "T (=m+1)" remain(s) at the end of the sheet bundle if T sheets P are introduced to the stacking unit 30 together in the case where the number of sheets P conveyed from the image forming apparatus 19 to form one sheet bunch Q is not a multiple of the batch feed number T.

For example, in the case of adopting a two-sheet simultaneous batching conveying method for temporarily storing one odd-numbered sheet P in the sheet saving section 20 and feeding (conveying) it to the stacking section 30 while causing it to accompany an even-numbered sheet P coming next, one sheet remains in the end if the number of the sheets P in one bundle is an odd number. The remaining one sheet cannot be kept temporarily stored in the sheet saving section 20 (i.e., the first sheet P of the next bundle is coming on, and the remaining sheet cannot be fed to the stacking section 30 together with the coming sheet P).

Accordingly, the last one sheet P is directly fed to the stacking section 30 without via the sheet saving section 20. However, this makes it impossible to ensure a time to align and staple the sheet bundle Q in the stacking section 30. In order to solve such an inconvenience, the conveyance of the sheet P of the next bundle is temporarily stopped at a suitable position before the sheet saving section 20 in the invention disclosed in Japanese Unexamined Patent Publication No. 2004-246056 mentioned above, thereby ensuring a time for the post-processing to be applied to the previous sheet bundle Q.

However, if the conveyance of the sheets P of the next bundle is temporarily stopped, the image formation processing in the image forming apparatus 19 has to be stopped, thereby causing a problem of a reduction in the efficiency of the image formation processing. The embodiment is designed to solve such a problem.

Figure 5:
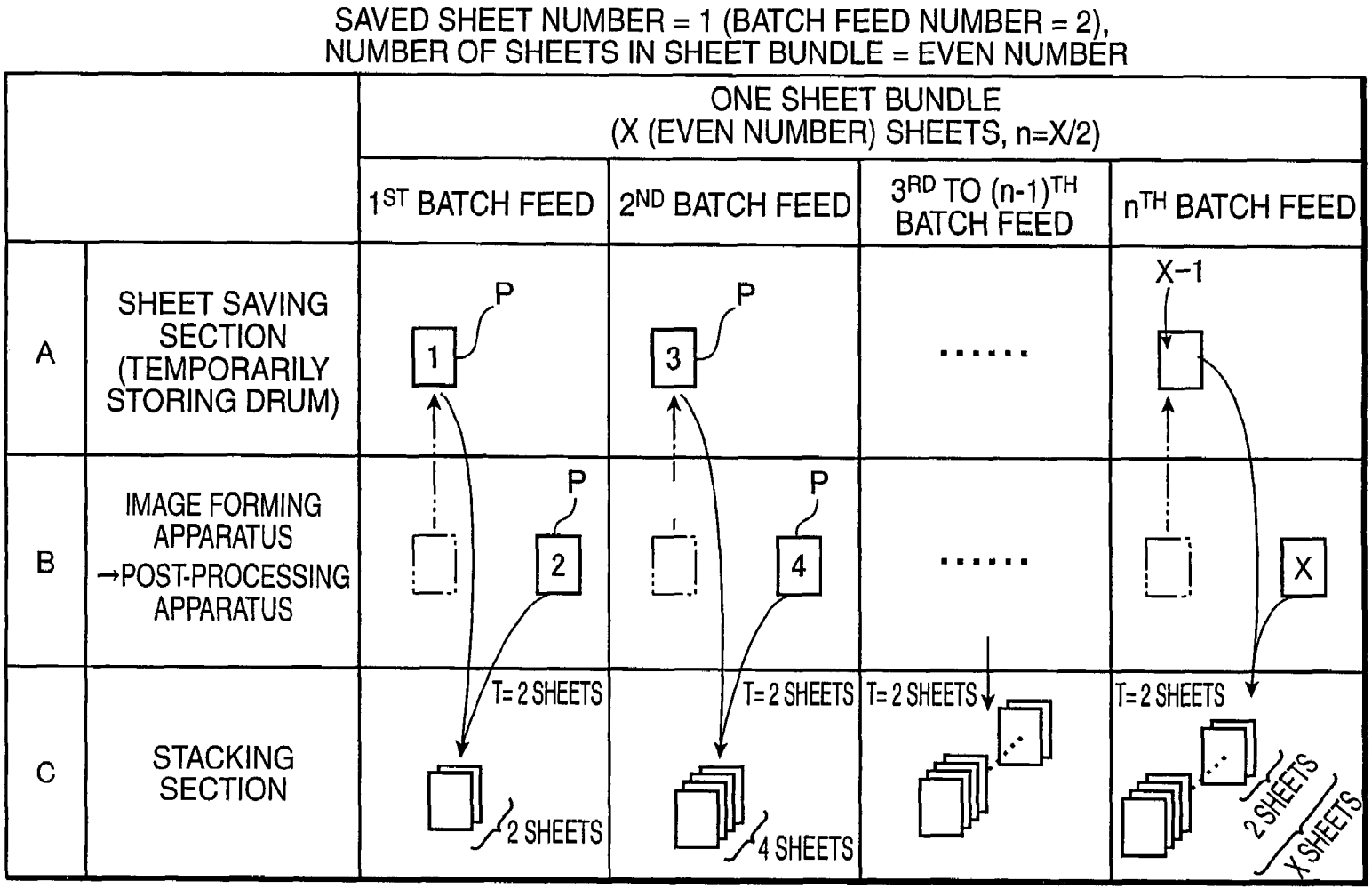
FIG. 5 is a chart showing a first mode (one sheet is saved and two sheets are batch fed to the stacking section) which is a basic of a multiple-sheet simultaneous batch feeding method according to the embodiment, wherein the number of sheets in one bundle (sheet bundle) is an even number.
Figure 6:
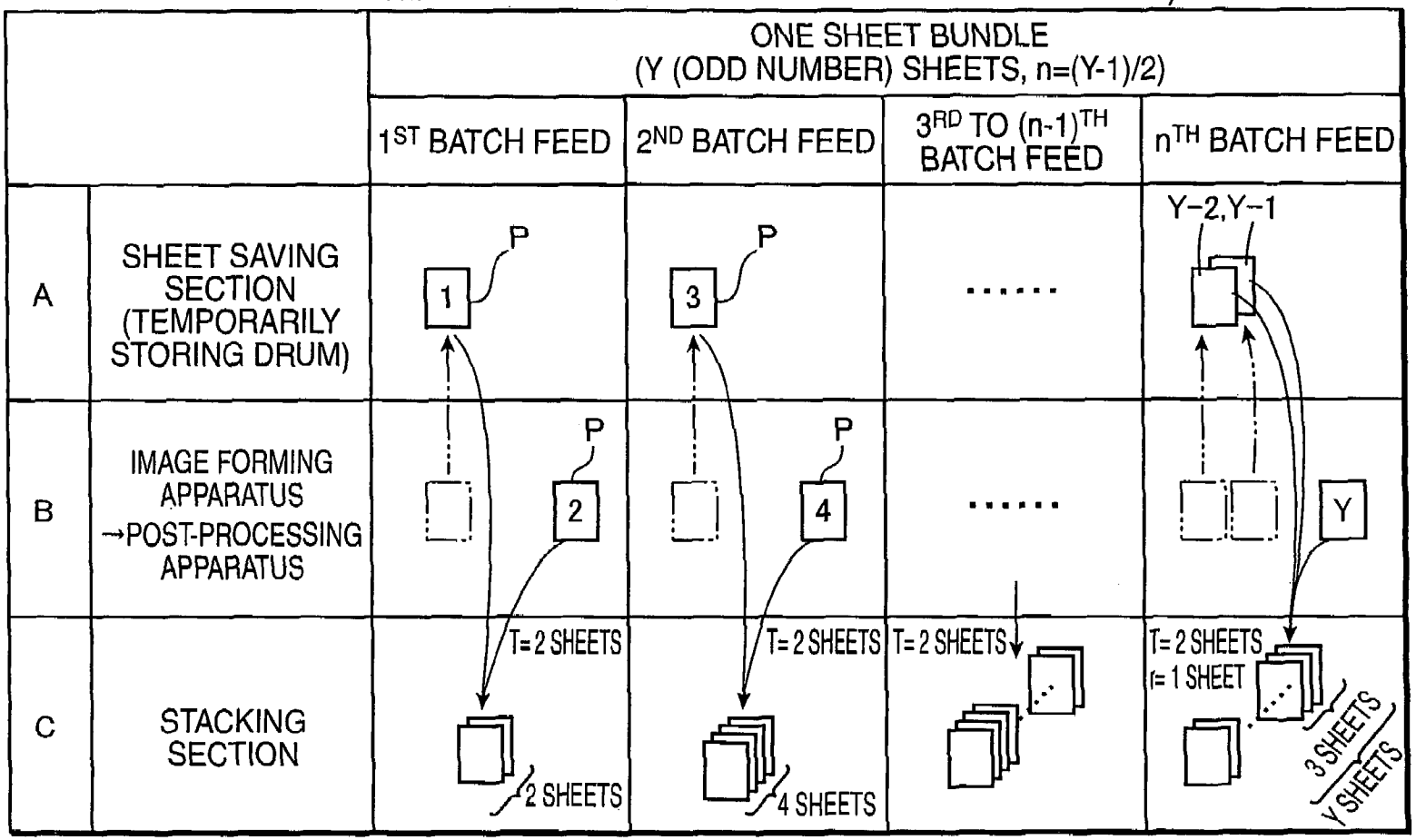
FIG. 6 is a chart showing the first mode as a basic of the multiple-sheet simultaneous batch feeding method according to the embodiment, wherein the number of sheets in one bundle (sheet bundle) is an odd number.

FIGS. 5 and 6 are charts showing a first mode (one sheet is saved, and two sheets are simultaneously fed to the stacking section 30) which is a basic of a multiple-sheet simultaneous batch feeding method according to the embodiment, wherein FIG. 5 shows a case where the number of sheets P in one bundle is an even number X and FIG. 6 shows a case where the number of sheets P in one bundle is an odd number Y. Rectangular figures in FIGS. 5 and 6 represent sheets P, and numbers therein represent the order of conveyance of the respective sheets P in the bundle. In this embodiment, the number (saved-sheet number) m of the sheets P to be temporarily stored (saved) in the sheet saving section 20 is one.

First, as shown in FIG. 5, in the case of processing the even number X of the sheets P, the first sheet P (shown with "1" in the rectangular figure) shown in phantom line in FIG. 5 and fed from the image forming apparatus 19 to the sheet post-processing apparatus 10 via the sheet receiving opening 111 is carried into the annular conveyance path R3 of the temporarily storing drum 21 in the sheet saving section 20 (shown in phantom line in row B in FIG. 5) via the entrance switching guide 25 set in the general-purpose tray oriented posture Z5 (see FIG. 2), the first switching guide 23 set in the annular conveyance path oriented posture Z2 and the second switching guide 24 set in the annular conveyance path oriented posture Z4 after having punching applied thereto in the punch unit 12, and is temporarily stored therein as shown in the first row A.

Subsequently, the second sheet P shown with "2" in the rectangular figure in the row B of FIG. 5 is fed from the image forming apparatus 19. The entrance switching guide 25 (see FIG. 2) having been set in the general-purpose tray oriented posture Z5 is displaced to the stacking-section oriented posture Z6 and the drum motor 212 is driven during a period up to the arrival of the second sheet P at the sheet saving section 20. The first sheet P shown with "1" in the row A of FIG. 5 and temporarily stored in the annular conveyance path R3 is caused to accompany the second sheet P shown with "2" in the row B of FIG. 5 to simultaneously two sheets P to the stacking section 30 via the entrance switching guide 25 (row C of FIG. 5) by the resulting clockwise rotation of the temporarily storing drum 21 about its center axis.

The two sheets P simultaneously fed to the stacking section 30 are aligned by the upward and downward movements of the sheet elevating member 43 after being received by the sheet elevating member 43.

Thereafter, in a similar manner, the odd-numbered sheet P fed from the image forming apparatus 19 to the sheet post-processing apparatus 10 is temporarily stored in the sheet saving section 20 and is fed to the stacking section 30 while being caused to accompany the succeeding even-numbered sheet P, so that two sheets are simultaneously and successively fed to the stacking section 30. When the last even-numbered sheet P shown with "X" in the row B of FIG. 5 is fed from the image forming apparatus 19, the $X^{th}$ sheet P is fed to the stacking unit 30 while accompanying the preceding $(X\text{-}1)^{th}$ sheet temporarily stored in the sheet saving section 20, thereby completing the feed of the sheets P to the stacking section 30 for one sheet bundle Q.

The sheet bundle Q fed to the stacking section 30 is stapled after being aligned in a specified manner. Simultaneously with the successive conveyance of the stapled sheet bundle Q to the general-purpose tray 14 (see FIG. 1) by the upward movement of the sheet elevating member 43, the next sheet P is fed from the image forming apparatus 19 to the sheet post-processing apparatus 10, which can successively receive the sheets P at the same conveying intervals as in the case of the previous sheet bundle Q without an idle time after receiving the first sheet P of the next sheet bundle Q, and applies the specified post-processing.

Thus, in the case where the number of the sheet P saved in the sheet saving section 20 is one and two sheets P are simultaneously fed to the stacking section 30, all the sheets P are fed in pairs from the first feed to the stacking section 30 to the nth (where n is X/2) feed to the stacking section 30 if the number of the sheets P in the sheet bundle Q is the even number X. Thus, times necessary for the aligning and the stapling in the stacking section 30 can be ensured by just that much.

In short, since a sum of a time required for the stapling applied after all the sheets P of the sheet bundle Q are fed to the stacking section 30 and a time required to discharge the sheet bundle Q after the stapling is completed is longer than a time required only for the aligning, if too many sheets are processed per unit time in the image forming apparatus 19 (i.e., if the image forming apparatus 19 carries out a considerable high-speed processing), the first sheet P of the next sheet bundle Q cannot be received by the sheet post-processing apparatus without suspension. Thus, the first mode in which two sheets are simultaneously fed is applied to the case where the image forming apparatus 19 processes at a somewhat lower speed.

If the number of the sheets P in the sheet bundle Q is the odd number ("Y") in the first mode (one sheet P is saved, and two sheets are simultaneously fed) as shown in FIG. 6, the last one sheet remains if the sheets P are fed in pairs to the stacking section 30. This remaining one sheet cannot be saved in the sheet saving section 20 because the first sheet P of the next sheet bundle Q is coming on. Accordingly, in the embodiment, the two sheets P preceding the last sheet P are saved in the sheet saving section 20, and three sheets including the two saved sheets P and the last sheet P are simultaneously fed together to the stacking section 30. In other words, so-called three-sheet feeding is adopted for the last three sheets P. In this case, the number n of the simultaneous feeds (batch feeds) is: $n=(Y-1)/2$.

In the case where the sheets P are fed in pairs and the number of the sheets in the sheet bundle Q is an odd number, three sheets are simultaneously fed to the stacking section 30 during the $n^{th}$ feed, thereby solving an inconvenience of leaving the last one sheet of the sheet bundle Q as a remainder. Therefore, the succeeding sheet bundle Q can be continuously post-processed at the same conveying interval without suspending the processing of the image forming apparatus 19.

Next, a second mode of the multiple-sheet simultaneous batch feeding method according to the embodiment is described with reference to FIGS. 7 to 9.

Figure 7:
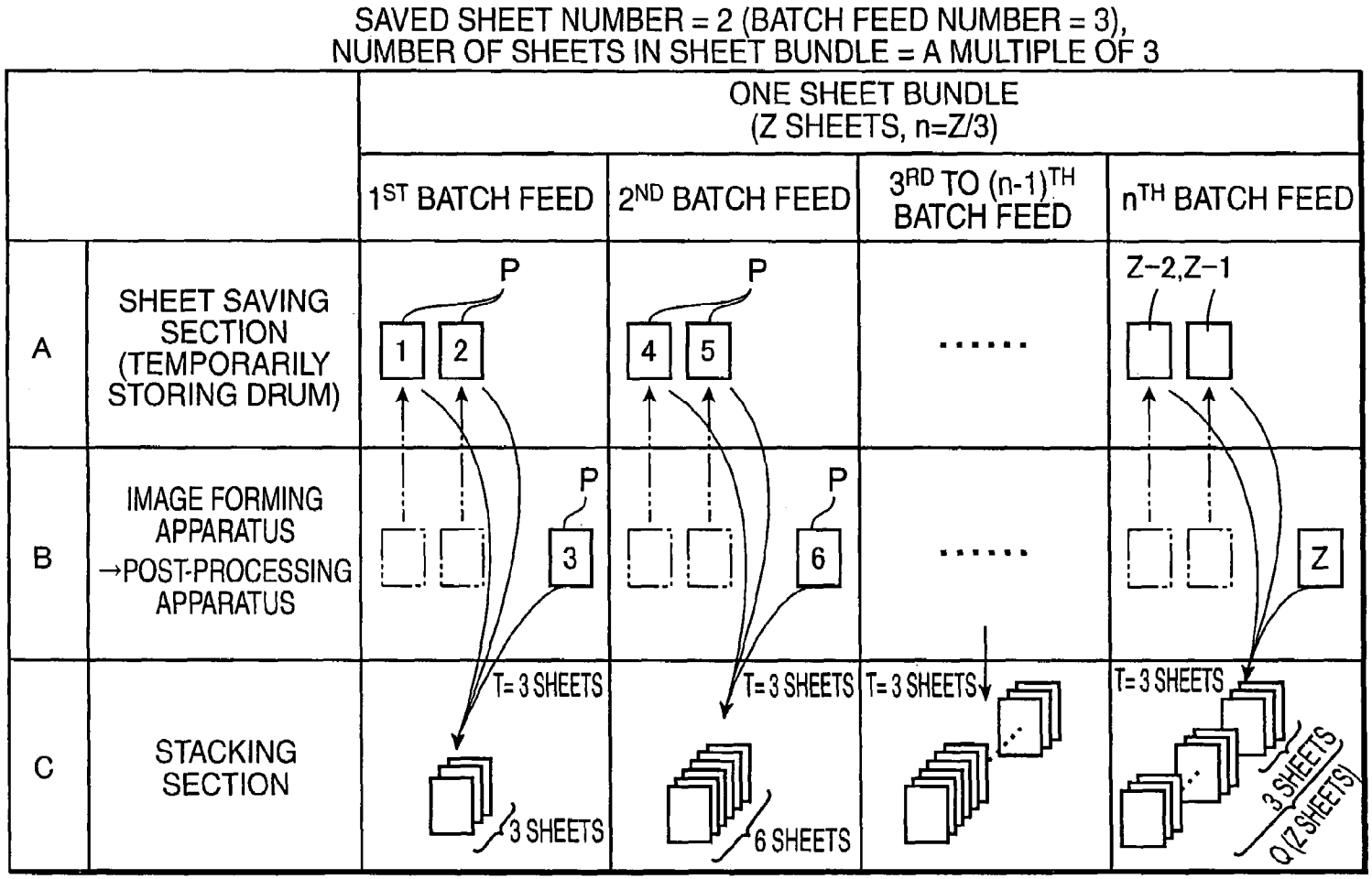
FIG. 7 is a chart showing a second mode of the multiple-sheet simultaneous batch feeding method according to the embodiment, wherein the number of sheets in one bundle (sheet bundle) is a multiple of three.
Figure 8:
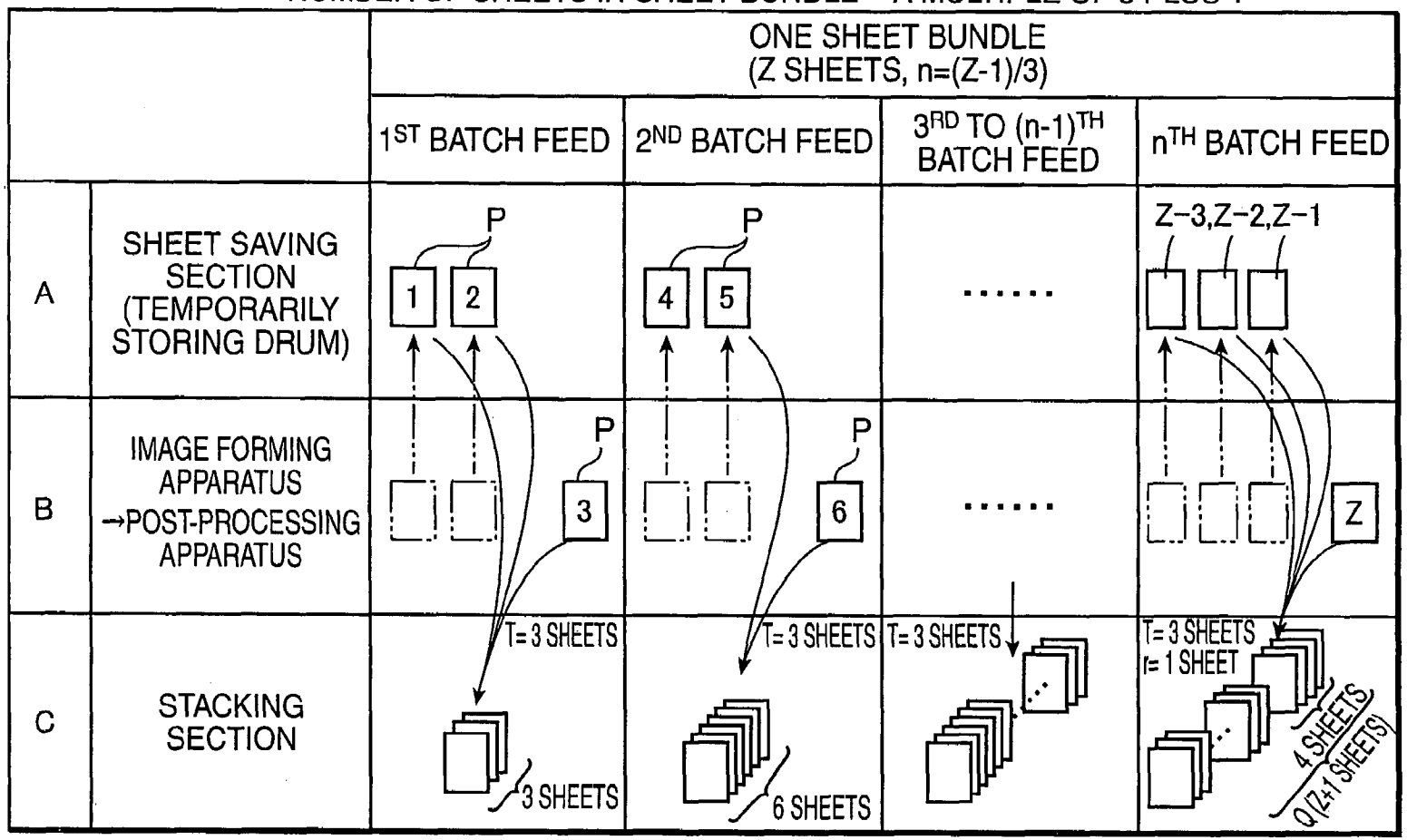
FIG. 8 is a chart showing the second mode of the multiple-sheet simultaneous batch feeding method according to the embodiment, wherein the number of sheets in one bundle (sheet bundle) is a multiple of three plus one.
Figure 9:
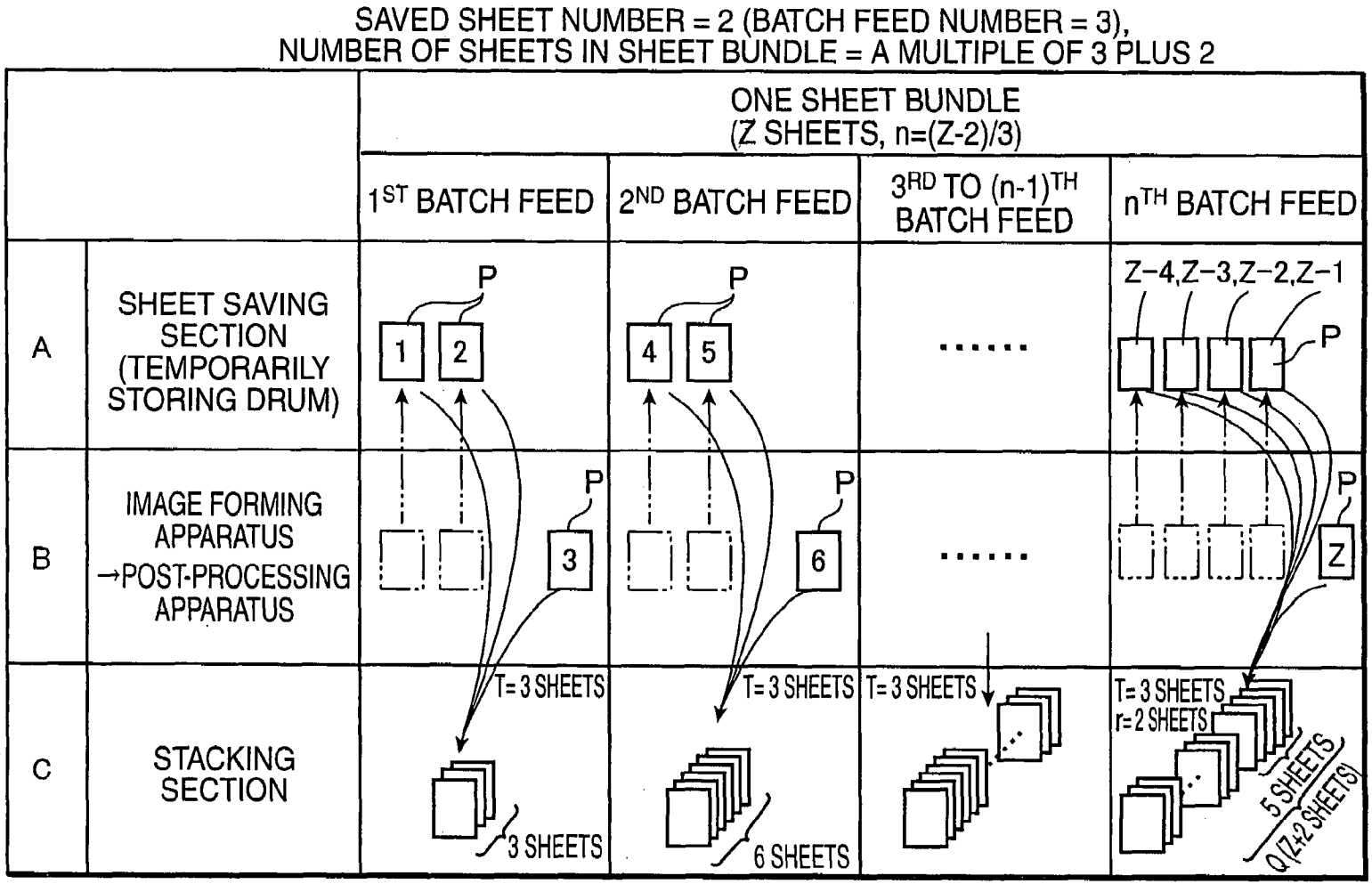
FIG. 9 is a chart showing the second mode of the multiple-sheet simultaneous batch feeding method according to the embodiment, wherein the number of sheets in one bundle (sheet bundle) is a multiple of three plus two.

FIGS. 7 to 9 are charts showing the second mode of the multiple-sheet simultaneous batch feeding method according to the embodiment, wherein FIG. 7 shows a case where the number of sheets in one bundle (sheet bundle Q) is a multiple of three, FIG. 8 shows a case where the number of sheets in one bundle (sheet bundle Q) is a multiple of three plus one, and FIG. 9 shows a case where the number of sheets in one bundle (sheet bundle Q) is a multiple of three plus two.

First, as shown in FIG. 7, in the case where the number Z of the sheets P is a multiple of three, the first and second sheets P are first saved in the sheet saving section 20, are fed to the stacking section 30 by being caused to accompany the third sheet P in the first feed (n=1) of three sheets. Thereafter, the sheets P are batch fed in threes in a similar manner. The post-processing of this sheet bundle Q is completed by carrying out the $n^{th}$ feed (n=Z/3) of three sheets P.

Contrary to the above, in the case where the number of the sheets P of the sheet bundle Q is "a multiple of three plus one" as shown in FIG. 8, a total of three sheets including the "$(Z-3)^{th}$ sheet", the "$(Z-2)^{th}$ sheet" and the "$(Z-1)^{th}$ sheet" are carried into the stacking section 30 while being caused to accompany the last $Z^{th}$ sheet P, i.e., four sheets P are carried into the stacking section 30, after being temporarily stored in the sheet saving section 20.

Further, in the case where the number of the sheets P of the sheet bundle Q is "a multiple of three plus two" as shown in FIG. 9, a total of four sheets including the "$(Z-4)^{th}$ sheet", the "$(Z-3)^{th}$ sheet", the "$(Z-2)^{th}$ sheet" and the "$(Z-1)^{th}$ sheet" are carried into the stacking section 30 by being caused to accompany the last $Z^{th}$ sheet P, i.e., five sheets P are carried into the stacking section 30, after being saved in the sheet saving section 20.

In the case of the second mode (two sheets are saved and three sheets are simultaneously fed), a considerable time can be gained by letting two sheets P saved in the sheet saving section 20. Thus, considerably long times can be ensured for the aligning and the stapling in the stacking section 30, with the result that the sheet post-processing apparatus 10 can deal with the faster processing of the image forming apparatus 19.

It is also possible to set the number (m) of the sheets P to be saved at four or more. In this case, T (=m+1) sheets are simultaneously batch fed to the stacking section 30. This difference only depends on the increase of "m" to 4 or more, and the basic concept of the second embodiment also applies in these cases.

Figure 10:
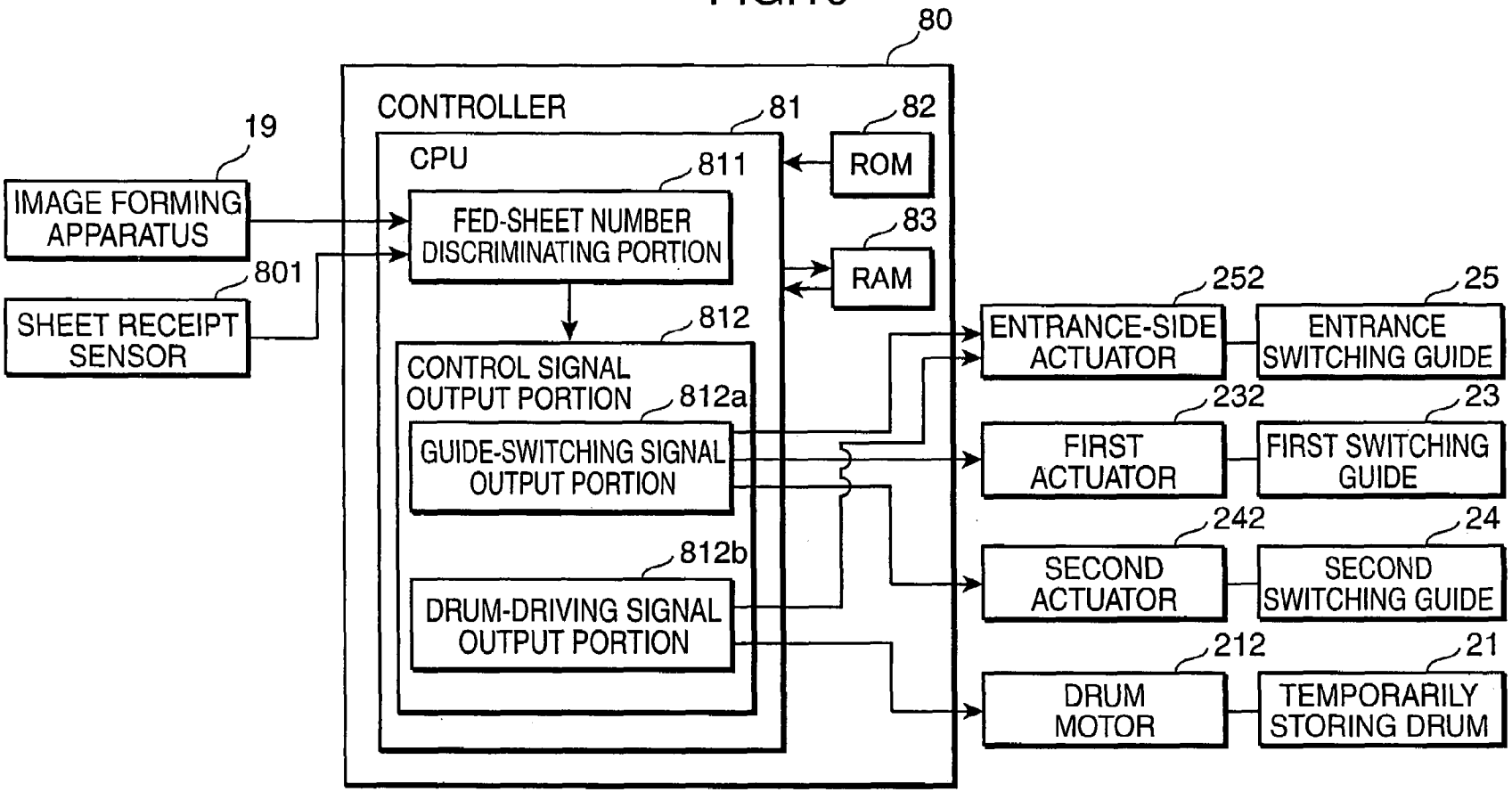
FIG. 10 is a block diagram showing a simultaneous batch feed control by a controller in the sheet post-processing apparatus.

Next, a control of feeding a plurality of sheets P in the sheet post-processing apparatus 10 (simultaneous batch feed) is described with reference to FIG. 10. FIG. 10 is a block diagram showing one embodiment of the control of the simultaneous batch feed by a controller in the sheet post-processing apparatus 10. As shown in FIG. 10, a controller 80 has a basic construction including a CPU 81 as a central processing unit, a ROM 82 and a RAM 83 attached to the CPU 81. A program for executing this control is stored in the ROM 82, and is read into the CPU 81 every time the sheet post-processing apparatus 10 is turned on. Contrary to this, the RAM 83 is used for writing and reading temporary data necessary for the control. For example, the number of the sheets P being currently counted and the like are renewably saved in the RAM 83.

The CPU 81 includes a fed-sheet number discriminating portion (sheet specification discriminating portion) 811 and a control signal output portion 812 for outputting control signals to specified portions in accordance with the discrimination result of the fed-sheet number discriminating portion 811.

The fed-sheet number discriminating portion 811 discriminates whether or not the sheet P being conveyed from the image forming apparatus 19 belongs to the same sheet bundle Q and the order of the currently conveyed sheet P in the bundle, and outputs a command signal to the control signal outputting portion 812 based on this discrimination result.

For this purpose, a sheet receipt sensor (page number sensor) 801 (see FIG. 1) for detecting the transfer of the sheet P from an discharge opening 191 to the sheet post-processing apparatus 10 is disposed at a specified position of the entrance-side conveyance path R1 (e.g., in vicinity of the sheet receiving opening 111), and a detection signal is inputted to the fed-sheet number discriminating portion 811 every time this sheet receipt sensor 801 detects the sheet. The fed-sheet number discriminating portion 811 discriminates the receipt of the sheet P by the sheet post-processing apparatus 10 every time this detection signal is inputted, and increments the number of the received sheets.

On the other hand, the number of the sheets P in one bundle to be post-processed is outputted beforehand from the image forming apparatus 19 to the fed-sheet number discriminating portion 811. Accordingly, the fed-sheet number discriminating portion 811 can discriminate the order of the sheet P currently conveyed from the image forming apparatus 19 to the sheet post-processing apparatus 10 in this sheet bundle based on page information from the image forming apparatus and detection information detected by the sheet receiving sensor 801.

It should be noted that the number of the sheets P per bundle is set by the input of page information counted upon the reading of an automatic document reader provided in a copier to the fed-sheet number discriminating portion 811 if the image forming apparatus 19 is the copier; is set by the input of page information counted by a facsimile machine as a transmission end to the fed-sheet number discriminating portion 811 if the image forming apparatus 19 is a facsimile machine; and is set by the input of page information outputted from a specified computer to the fed-sheet number discriminating portion 811 if the image forming apparatus 19 is a printer.

The control signal output portion 812 judges whether the sheet P is to be saved in the sheet saving section 20 or to be directly fed to the stacking section 30 depending on the order of this sheet P in the bundle after recognizing the receipt of the sheet P from the image forming apparatus 19 by the sheet post-processing apparatus 10 and the number of the sheets P in the bundle from the signal from the fed-sheet number discriminating portion 811, and outputs specified control signals based on the judgment result. Such a control signal outputting portion 812 includes a guide-switching signal output portion 812*a* and a drum-driving signal output portion 812*b*.

The guide-switching signal output portion 812*a* outputs control signals to an entrance-side actuator 252, a first actuator 232 and a second actuator 242 (specifically to solenoids constituting the actuators) to set the entrance switching guide 25, the first switching guide 23 and the second switching guide 24 in specified postures depending on the order of the sheet P currently being conveyed from the image forming apparatus 19 to the sheet post-processing apparatus 10 in the bundle. The respective guides 25, 23, 24 are set in the specified postures by these control signals, whereupon the sheet P is saved on the temporarily storing drum 21 of the sheet saving section 20 and then fed to the stacking section 30 while being caused to accompany the sheet P conveyed next.

Specifically, in the case where the processing in the sheet post-processing apparatus 10 is carried out while the sheets P are saved in pairs and fed in threes, the entrance switching guide 25 is set in the general-purpose tray oriented posture Z5 (see FIG. 2), the first switching guide 23 is set in the annular conveyance path oriented posture Z2 and the second switching guide 24 is set in the annular conveyance path oriented posture Z4 by being driven by the corresponding actuators 252, 232, 242 in accordance with the control signals from the guide-switching signal output portion 812*a* (if each switching guide is already in the specified posture, the corresponding actuator is not driven) for the first sheet P and the sheets P each having an order of a multiple of three plus one and the second sheet P and the sheets P each having an order of a multiple of three plus two. For the third sheet P and the sheets P each having an order of a multiple of three, the entrance switching guide 25 is displaced from the general-purpose tray oriented posture Z5 to the stacking-section oriented posture Z6 by being driven by the entrance-side actuator 252 in accordance with the control signal from the guide-switching signal output portion 812*a*, whereby the sheets P saved in the sheet saving section 20 can be fed to the stacking section 30 while being caused to accompany the sheet P conveyed next.

The number of the sheets P to be saved in the sheet saving section 20 (i.e., the value of "m") is set beforehand as peculiar to the apparatuses 19, 10 in accordance with the image formation processing speed of the image forming apparatus 19 and the processing speed in the stacking section 30 of the sheet post-processing apparatus 10, and the value once determined is not changed unless the functions are upgraded.

The drum-drive signal output portion 812*b* outputs control signals to the entrance-side actuator 252 and the drum motor 212 to feed the sheet(s) P saved in the sheet saving section 20.

The entrance switching guide 25 having been set in the stacking-section oriented posture Z6 is displaced to the general-purpose tray oriented posture Z5 by being driven by the entrance-side actuator 252 upon the input of the control signal to the entrance-side actuator 252. By the clockwise rotation of the temporarily storing drum 21 driven by the drum motor 212 in this state, the sheets P wound around the circumferential surface of the temporarily storing drum 21 are fed to the stacking section 30 through the guide of the entrance switching guide 25 and via the pair of second conveyance rollers 254, the biasing member 60 and the stacking-section oriented conveyance path R5 while accompanying the sheet P.

Figure 11:
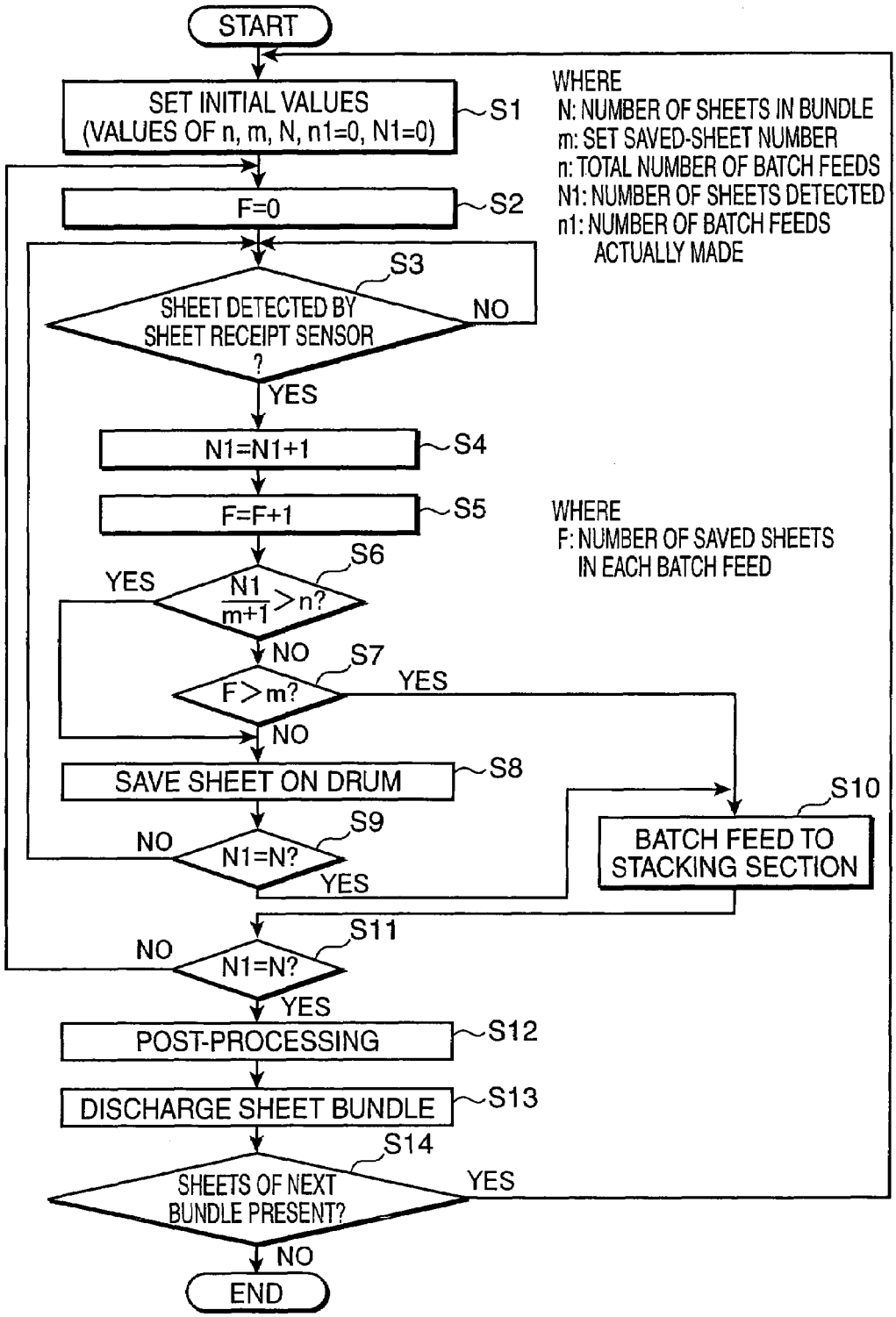
FIG. 11 is a flowchart showing a batch feed control flow of the sheet to the stacking section.

A flow of the save control for the sheets P is described with reference to FIG. 11. FIG. 11 is a flowchart showing one embodiment of a flow of the batch feed control for the sheets P fed to the stacking section 30. Prior to the description with reference to this flowchart, terms are defined first. Specifically, it is assumed that N, "m" denote the number of the sheets P of one sheet bundle Q to be processed in the sheet post-processing apparatus 10 and the number (set saved-sheet number) of the sheets P to be saved in the sheet saving section 20 out of those successively conveyed, respectively. Accordingly, a sum total T (="m+1") of the "m" saved sheets plus one sheet conveyed next are fed to the stacking section 30 together.

It is also assumed that the $n^{th}$ feed is the last simultaneous feed (batch feed) of the sheets P. This value "n" can be calculated by "n=N/(m+1)". If the number N of the sheets P is not a multiple of "m+1", the value of "n" is rounded down to the nearest whole number. This means that the number of the sheets to be simultaneously fed from the first feed to the $n^{th}$ feed is "m+1" if the number of the sheets P in the bundle is a multiple of "m+1", whereas the number of the sheets to be simultaneously fed is "m+1+r" if the number of the sheets P in the bundle is not a multiple of "m+1" (i.e., a remainder r is left upon dividing N by (m+1)).

Upon the start of the batch feed control, initial values are first set in Step S1. The initial values include an initial value "0" of a detected-sheet number "N1" of the sheets P detected by the sheet receipt sensor 801 and an initial value "0" of a number "n1" of the simultaneous feeds already made in addition to the total number "n" of the simultaneous feeds, the value of the set saved-sheet number "m" and the value of the number "N" of the sheets P in the bundle to be processed.

The set saved-sheet number "m" is a value set beforehand in accordance with the processing abilities of the image forming apparatus 19 and the sheet post-processing apparatus 10. The sheet number N is a known value inputted from the image forming apparatus 19. The total simultaneous feed number (the number of sets to be batch fed) n is a value obtained by rounding the value calculated by N/(m+1) down to the nearest whole number. The detected sheet number N1 is a numerical value incremented by one every time the sheet receipt sensor 801 detects the sheet P, and indicative of the number of the sheets P actually conveyed from the image forming apparatus 19 to the sheet post-processing apparatus 10. The simultaneous feed number "n1" is a numerical value incremented by one every time the simultaneous feed of the sheets P to the stacking section 30 is made, and indicative of how many simultaneous feeds have been made up to the present time.

Subsequently, a flag F is set to an initial value "0" in Step S2. The flag F indicates the number of the sheets P saved during each simultaneous feed, and the value thereof is incremented by one every time the sheet P is saved during the simultaneous feed and cleared upon reaching the set saved-sheet number "m".

Subsequently, it is discriminated in Step S3 whether or not the sheet receipt sensor 801 has detected the sheet P. Upon detecting the sheet P (YES in Step S3), the number of the sheets P is incremented through an operation of "N1=N1+1" in Step S5, and the number of the saved sheets P is incremented through an operation of "F=F+1".

Subsequently, it is discriminated in Step S6 whether or not a quotient of the detected sheet number N1 divided by the number (m+1) of the sheets to be simultaneously fed is larger than the preset total simultaneous feed number "n" (i.e., whether or not this quotient has a remainder and is larger than "n", i.e., whether or not "N1/(m+1)>n" is satisfied). If the discrimination result is negative (NO in Step S6), it is discriminated in Step S7 whether or not the value of the flag F is larger than the set saved-sheet number "m" (F>m). Unless F>m, the sheet P is saved onto the temporarily storing drum 21 in Step S8. On the other hand, this routine skips to Step S8 if N1/(m+1)>n in Step S6 (YES in Step S6).

If the value of the flag F is larger than the set saved-sheet number "m" in Step S7, Step S10 is carried out upon the judgment that the preset number of the sheets P are already saved on the temporarily storing drum 21, whereby the sheet P is fed to the stacking section 30 together with the already saved sheet(s) P without being saved.

After the sheet P is saved on the temporarily storing drum 21 in Step S8, Step S9 is carried out to discriminate whether or not the detected-sheet number N1 coincides with the sheet number N (N1=N). If these two values are at variance, i.e., the sheet P currently being conveyed is not the last sheet in the bundle (NO in Step S9), this routine returns to Step S3 for the sheet P to be conveyed next. If this sheet P is the last sheet (YES in Step S9), Step S10 is carried out because there is left no other sheet to be post-processing in this bundle.

Subsequently, it is discriminated again whether or not the detected-sheet number N1 coincides with the sheet number N. If these two values are at variance (i.e., if there still exists the sheet P to be saved), this routine returns to Step S2 to clear the flag F and the succeeding Steps S3 to S10 are carried out again. If these two values agree with each other (i.e., the sheet P is the last sheet of the bundle), a specified post-processing (stapling) is applied to the sheet bundle Q already formed in the stacking section 30 (Step S12) and then the sheet bundle Q is discharged toward the general-purpose tray 14.

Subsequently, it is discriminated in Step S14 whether or not the sheets P of the next bundle P are present. If the sheets P of the next bundle are successively conveyed (YES in Step S14), this routine returns to Step S1 and the respective Steps are carried out for the sheets P of the next bundle. If no sheet P of the next bundle is present (NO in Step S14), the batch feed control for the sheets P is ended.

As described in detail above, the sheet post-processing apparatus 10 according to the embodiment is for applying the specified processing to the sheet bundle Q formed by successively receiving the sheets P fed from the image forming apparatus 19 as the upstream apparatus, and includes the stacking section 30 for stacking the sheets P successively received from the image forming apparatus 19 for the post-processing; the sheet saving section 20 disposed at the position immediately upstream of the stacking section 30 for temporarily storing a specified number of the sheets P conveyed toward the stacking section 30 and then simultaneously feeding them to the stacking section 30 while causing them to accompany the sheet P conveyed next; and the controller 80 for, if the sum total of the number of the sheet(s) P to be saved in the sheet saving section 20 prior to the last sheet P of the sheet bundle Q and this last sheet P falls short of the preset batch feed number, executing such a control as to simultaneously feed the sheets P falling short of the batch feed number while causing them to accompany the temporarily saved sheet(s) P already saved in the sheet saving section 20.

According to such a construction, the sheets P successively conveyed from the image forming apparatus 19 to the sheet post-processing apparatus 10 are fed to the stacking section 30 as follows. After being temporarily saved in the sheet saving section 20, a specified number of the sheets are fed to the stacking section 30 while accompanying the sheet P conveyed next, and such a processing is repeated. Thus, as compared to a case where the sheets P are directly introduced one by one to the stacking section 30, the sheets P can be conveyed from the image forming apparatus 19 to the sheet post-processing apparatus 10 at a specified conveying speed without depending on the time required to align the sheet bundle Q successively formed in the stacking section 30. As a result, the speeding-up of the sheet processing of the image forming apparatus 19 can be dealt with.

Since the controller 80 executes such a control as to simultaneously feed the sheets P falling short of the batch feed number while causing them to accompany the temporarily saved sheet(s) P already saved in the sheet saving section 20 if the sum total of the number of the sheet(s) P to be saved in the sheet saving section 20 prior to the last sheet P of the sheet bundle Q and this last sheet P falls short of the preset batch feed number, such an inconvenience that only the remaining sheets P have to be fed to the stacking section 30 can be avoided even if the quotient of the total number of the sheets P in the bundle divided by the batch feed number has a remainder. This obviates the need for suspending the conveyance of the first sheet P of the next sheet bundle Q, thereby contributing to an improvement in the overall sheet processing efficiency including the processing efficiency of the image forming apparatus 19.

Further, the sheet receipt sensor 801 is provided to detect the number of the sheets P received from the image forming apparatus 19, and the controller 80 includes the fed-sheet number discriminating portion 811 for specifying the sheet (s) P caused to accompany extra based on the number of the sheets P in the sheet bundle inputted beforehand and the number of the sheets detected by the sheet receipt sensor 801.

With such a construction, the fed-sheet number discriminating portion 811 specifies the sheet(s) P caused to accompany extra the temporarily saved sheets from the number of the sheets P in the sheet bundle Q inputted beforehand and the number of the sheets P detected by the sheet receipt sensor 801. Thus, the remaining sheets P including the one(those) preceding the last sheet P and the last sheet P can be properly fed to the sheet saving section 20 based on this specification result.

Since such a sheet post-processing apparatus 10 is applied as a post-processing apparatus for the image forming apparatus 19 in this embodiment, the image formation processing in the image forming apparatus 19 can be carried out at the specified intervals without being suspended regardless of whether the number of the sheets P in each sheet bundle Q is a multiple of the batch feed number (m+1). As a result, the processing efficiency of the image forming apparatus 19 can be improved, enabling the speeding-up of the image forming apparatus 19 to be dealt with.

The present invention is not limited to the foregoing embodiment, and may be embodied as follows.

Although the image forming apparatus 19 is used as an upstream apparatus in the foregoing embodiment, an upstream apparatus of the present invention is not limited to the image forming apparatus 19, and may be one of various apparatuses for applying specified processings to sheets such as ordinary printers.

Although the cases where the set saved-sheet number "m" is one or two (total number (batch feed number) T of the set saved-sheet number "m" and one succeeding sheet is two or three) are concretely described with reference to FIGS. 5 to 9 in the foregoing embodiment, the set saved-sheet number "m" is not limited to one or two according to the present invention and may be three or more.

Although the sheet saving section 20 as an auxiliary storing section includes the temporarily storing drum 21 for storing the sheet(s) P on its circumferential surface in the foregoing embodiment, an auxiliary storing section according to the invention is not limited to the sheet saving section 20 including the temporarily storing drum 21. For example, a straight temporarily storing tray may be provided, and the sheet(s) P may be fed to the stacking section 30 while being caused to accompany the next sheet by a switch-back method after being saved on this temporarily storing tray.

As described above, an inventive sheet post-processing apparatus for applying a specified post-processing to a sheet bundle formed by successively receiving sheets fed from an upstream apparatus, comprises a main storing section for storing the sheets successively received from the upstream apparatus while stacking the sheets one over another for the application of the post-processing; an auxiliary storing section disposed immediately upstream of the main storing section to form a set including a batch feed number of sheets to be batch fed, the auxiliary storing section being adapted to temporarily save a specified number of sheet(s) being fed to the main storing section and cause the temporarily saved sheet(s) to accompany the sheet fed next, thereby batch feeding the set of the sheets to the main storing section; and a controller for executing such a control as to batch feed remaining sheet(s) by causing the remaining sheets to accompany the temporarily saved sheet(s) of a previous set if the remaining sheet(s) falls short of the batch feed number.

With this construction, the sheets successively conveyed from the upstream apparatus to the post-processing apparatus are fed to the main storing section as follows. After being temporarily saved in the temporarily storing section, the specified number of the sheet(s) is/are fed to the main storing section while accompanying the sheet conveyed next, and such a processing is repeated. Thus, as compared to a case where the sheets are directly introduced one by one to the main storing section, the sheets can be conveyed from the upstream apparatus to the sheet post-processing apparatus at a specified conveying speed without depending on a time required to align the sheet bundle successively formed in the main storing section. This can contribute to the speeding-up of the sheet processing of the image forming apparatus.

Since the controller executes such a control as to batch feed the remaining sheets while causing them to accompany the temporarily saved sheet(s) of the previous set if the number of the remaining sheets of the sheet bundle immediately before the batch feed of the previous set falls short of the batch feed number, such an inconvenience that only the remaining sheets have to be fed to the main storing section can be solved even if the quotient of the total number of the sheets in the bundle divided by the batch feed number has a remainder. This obviates the need for suspending the conveyance of the first sheet of the next sheet bundle, thereby contributing to an improvement in the overall sheet processing efficiency including the sheet processing efficiency of the upstream apparatus.

It may be preferable that the sheet post-processing apparatus is further provided with a sheet number sensor for detecting the number of the sheets received from the upstream apparatus, and the controller includes a sheet specification discriminating portion for specifying the number of the remaining sheet(s) based on the number of the sheets inputted beforehand and the number of the sheets detected by the sheet number sensor.

With this construction, the sheet specification discriminating portion specifies the number of the sheets to accompany extra the temporarily saved sheet(s) (i.e., the number of the remaining sheets) based on the number of the sheets in the sheet bundle inputted beforehand from the upstream apparatus and the number of the sheets detected by the sheet number sensor. Thus, the remaining sheets including the one(those) preceding the last sheet and the last sheet in the sheet bundle can be introduced to the temporarily storing section based on this specification result.

Preferably, the upstream apparatus may be an image forming apparatus.

Such a restriction as to change processing intervals in the post-processing apparatus depending on the number of the sheets in the sheet bundle can be solved, and the image formation processing in the image forming apparatus can be carried out at specified intervals without being suspended. Since the image forming apparatus is used as the upstream apparatus, the processing efficiency of the image forming apparatus as the upstream apparatus can be improved, which can contribute to the speeding-up of the image formation processing.

This application is based on patent application No. 2004-331412 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A sheet post-processing apparatus for applying a specified post-processing to a sheet bundle formed by successively receiving sheets conveyed from an upstream apparatus, comprising:

a main storing section for storing sheets successively received from the upstream apparatus while stacking the sheets one over another for application of a post-processing;

an auxiliary storing section disposed immediately upstream of the main storing section to form a set including a batch feed number of sheets to be batch fed, the auxiliary storing section being adapted to temporarily save a specified number of sheet(s) being fed to the main storing section and cause the temporarily saved sheet(s) to accompany the sheet conveyed next, thereby batch feeding the set of the sheets to the main storing section; and a controller for executing such a control as to batch feed remaining sheet(s) by causing the remaining sheets to accompany the temporarily saved sheet(s) of a previous set if the remaining sheet(s) falls short of the batch feed number.

2. A sheet post-processing apparatus according to claim 1, further comprising a sheet number sensor for detecting the number of sheets received from the upstream apparatus, wherein the controller includes a sheet specification discriminating portion for specifying the number of the remaining sheet(s) based on the number of the sheets inputted beforehand and the number of sheets detected by the sheet number sensor.

3. A sheet post-processing apparatus according to claim 2, wherein the upstream apparatus is an image forming apparatus.

4. A sheet post-processing apparatus according to claim 1, wherein the upstream apparatus is an image forming apparatus.

* * * * *